US007682049B2

(12) United States Patent
Zheng et al.

(10) Patent No.: US 7,682,049 B2
(45) Date of Patent: Mar. 23, 2010

(54) LED LAMP

(75) Inventors: Shi-Song Zheng, Shenzhen (CN); Li He, Shenzhen (CN); Sai-Wen Wang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 1 day.

(21) Appl. No.: 12/102,867

(22) Filed: Apr. 15, 2008

(65) Prior Publication Data

US 2009/0257234 A1 Oct. 15, 2009

(51) Int. Cl.
*F21V 29/00* (2006.01)

(52) U.S. Cl. ..... 362/294; 362/249.02; 362/351

(58) Field of Classification Search ..... 362/218, 362/240, 345, 351, 356, 373, 410, 545, 547, 362/800; 257/79, 98, 99, 722; 165/104.33; 361/679.52, 679.54, 703, 704, 709, 714
See application file for complete search history.

(56) References Cited

U.S. PATENT DOCUMENTS

| | | | | |
|---|---|---|---|---|
| 7,396,146 | B2 * | 7/2008 | Wang | 362/294 |
| 7,458,706 | B1 * | 12/2008 | Liu et al. | 362/373 |
| 7,534,015 | B2 * | 5/2009 | Xu et al. | 362/373 |
| 2007/0236935 | A1 * | 10/2007 | Wang | 362/294 |
| 2007/0253202 | A1 * | 11/2007 | Wu et al. | 362/294 |
| 2009/0016062 | A1 * | 1/2009 | Lee et al. | 362/294 |
| 2009/0097241 | A1 * | 4/2009 | Xu et al. | 362/234 |
| 2009/0103308 | A1 * | 4/2009 | Xu et al. | 362/294 |

* cited by examiner

*Primary Examiner*—Hargobind S Sawhney
(74) *Attorney, Agent, or Firm*—Frank R. Niranjan

(57) ABSTRACT

An LED lamp includes a first heat sink, a plurality of LED modules and a connecting member. The first heat sink has base plate and a plurality of first fins arranged on the base plate. The LED modules are attached to a bottom surface of the base plate. Outer ends of the LED modules are located at a level higher than that of inner ends of the LED modules. The mounting base is alternatively fixed to one of a top and a bottom of the first heat sink so that the LED lamp can be selectively used as a floor lamp or a pedant lamp.

17 Claims, 6 Drawing Sheets

LED LAMP

BACKGROUND OF THE INVENTION

1. Field of the Invention

The present invention relates to an LED lamp for a lighting purpose, and more particularly to an improved LED lamp providing a large-scale light. The improved LED lamp can be easily selectively configured as a floor lamp or a suspension lamp.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

Known implementations of LED modules in an LED lamp make use of a plurality of individual LEDs to generate light that is sufficient and of satisfactory spatial distribution. The large number of LEDs leads to a more expensive module and one with greater power consumption. The greater power usage leads to greater heat output, which, if not adequately addressed at additional expense, impacts the LED lamp reliability.

A conventional LED lamp incorporates a heat dissipating configuration therein, which can dissipate heat generated by the LEDs timely. Thus, the conventional LED lamp can properly perform without overheating. However, to meet a demanding requirement of heat dissipation and provide a satisfactory illumination, this type of LED lamp at least has to consist of a heat sink, a cover and a connecting base, thereby complicating a structure of the LED lamp. As the complicated structure, the LED lamp usually has to be mounted in a predetermined way; for example, the LED lamp can only be held in position by a support of an upper end of a fixing rod whereby the LED lamp is used as a floor lamp. On the other hand, the LED lamp is suspended by a lower end of the fixing rod whereby the LED lamp is used as a pendant lamp. However, the conventional LED lamp can not be easily selectively configured so that it can be switched between a floor lamp and a pendant lamp, whereby the versatility of the conventional LED lamp is limited. Furthermore, in the conventional LED lamp, the LED modules are all mounted on a flat surface of the heat sink, whereby the illumination range of the conventional LED lamp is limited.

What is needed, therefore, is an improved LED lamp assembly which can overcome the above problems. The LED lamp has an enlarged illumination range. Furthermore, the LED lamp can be easily selectively configured to be switched between a floor lamp and a suspension lamp.

SUMMARY OF THE INVENTION

An LED lamp includes a first heat sink, a plurality of LED modules, a connecting member, a second heat sink and a cover. The first heat sink has base plate and a plurality of first fins arranged on the base plate. The LED modules are attached to inclined bottom surfaces of mounting portions protruding downwardly from a bottom surface of the base plate, wherein the LED modules are oriented downwardly and outwardly. The mounting base is alternatively fixed to a top the first heat sink or a bottom of the connecting member so that the LED lamp can be used as a floor lamp or a suspension lamp. The connecting member is fixed to the bottom surface of the base plate. The cover is secured to both the connecting member and the first heat sink. The cover forms a V-shaped space receiving the LED modules therein.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
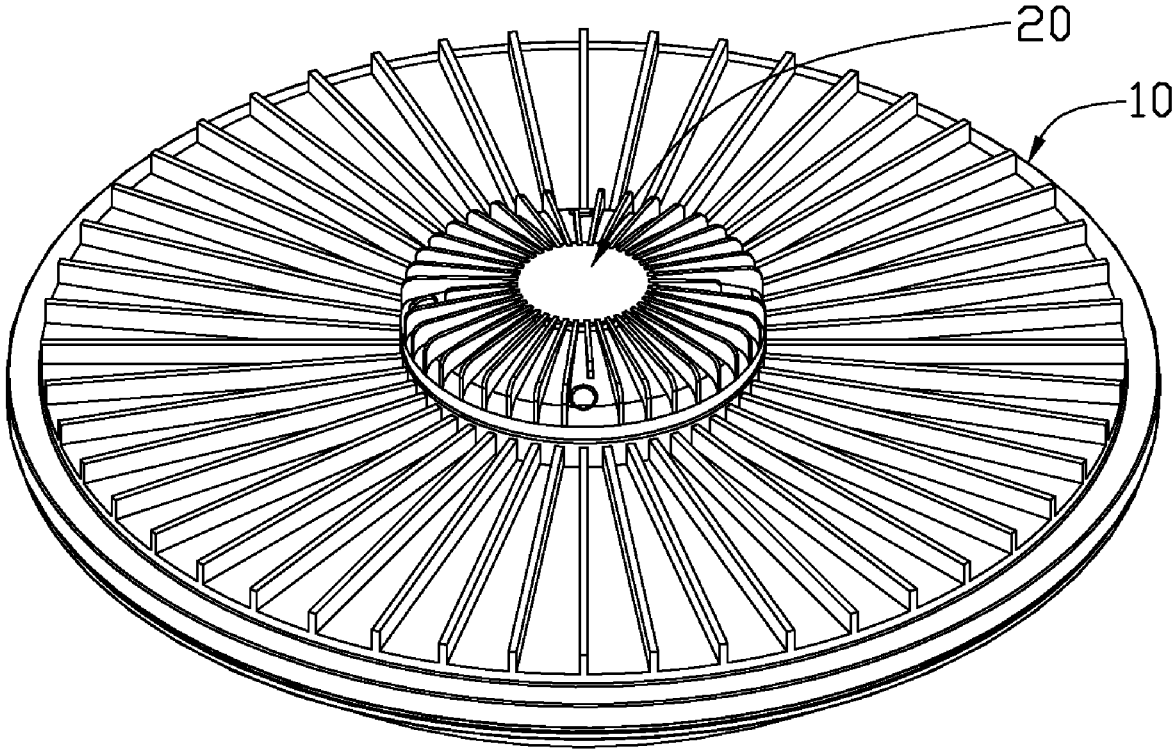
FIG. 1 is an isometric, assembled view of an LED lamp in accordance with a first preferred embodiment of the present invention.

Referring to FIGS. 1-4, an LED lamp in accordance with a first preferred embodiment is illustrated. The LED lamp assembly comprises a first heat sink 10, a second heat sink 20 fixed to a top of the first heat sink 10, a plurality of LED modules 30 attached to a bottom of the first heat sink 10, a connecting member 40 coupled to a central part of the bottom of the first heat sink 10, a cover 50 covering the LED modules 30 at the bottom of the first heat sink 10 and surrounding the connecting member 40, and a mounting base 60 connecting to a bottom of the connecting member 40. The mounting base 60 is for engaging with a fixing rod (not shown) to hold the LED lamp in position.

Figure 2:
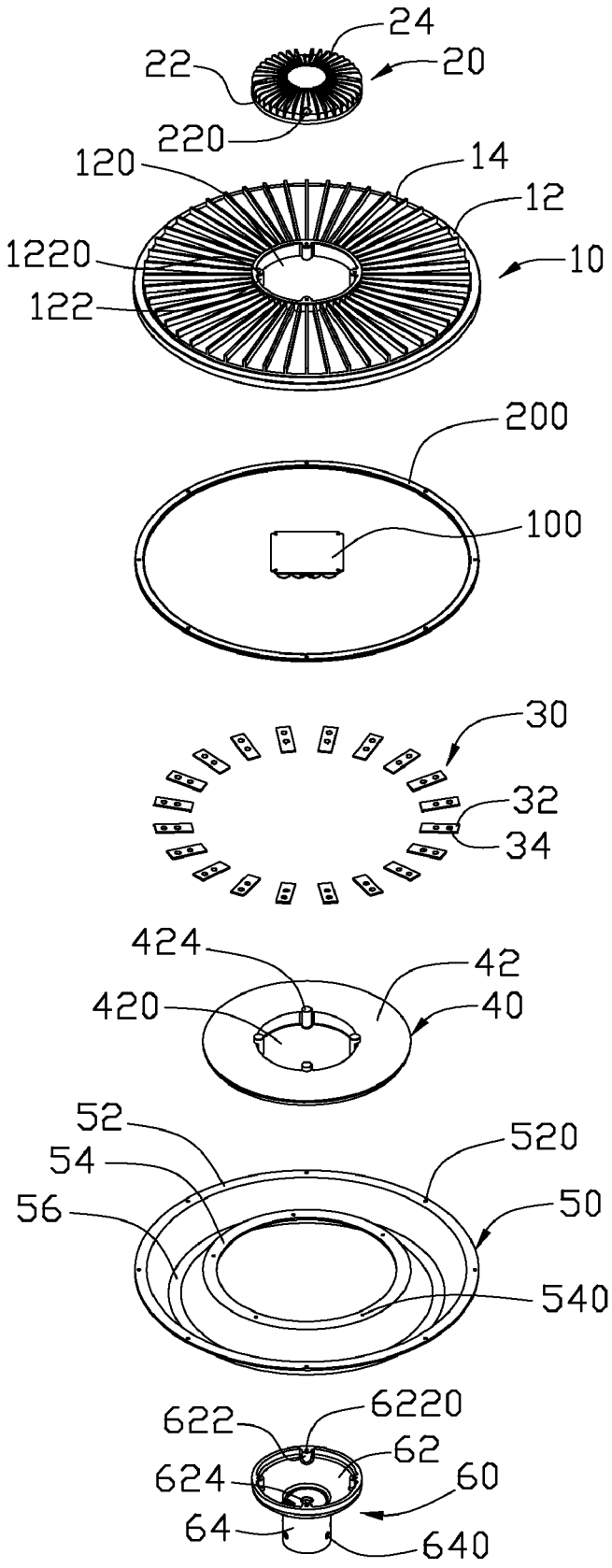
FIG. 2 is an exploded view of the LED lamp of FIG. 1.
Figure 3:
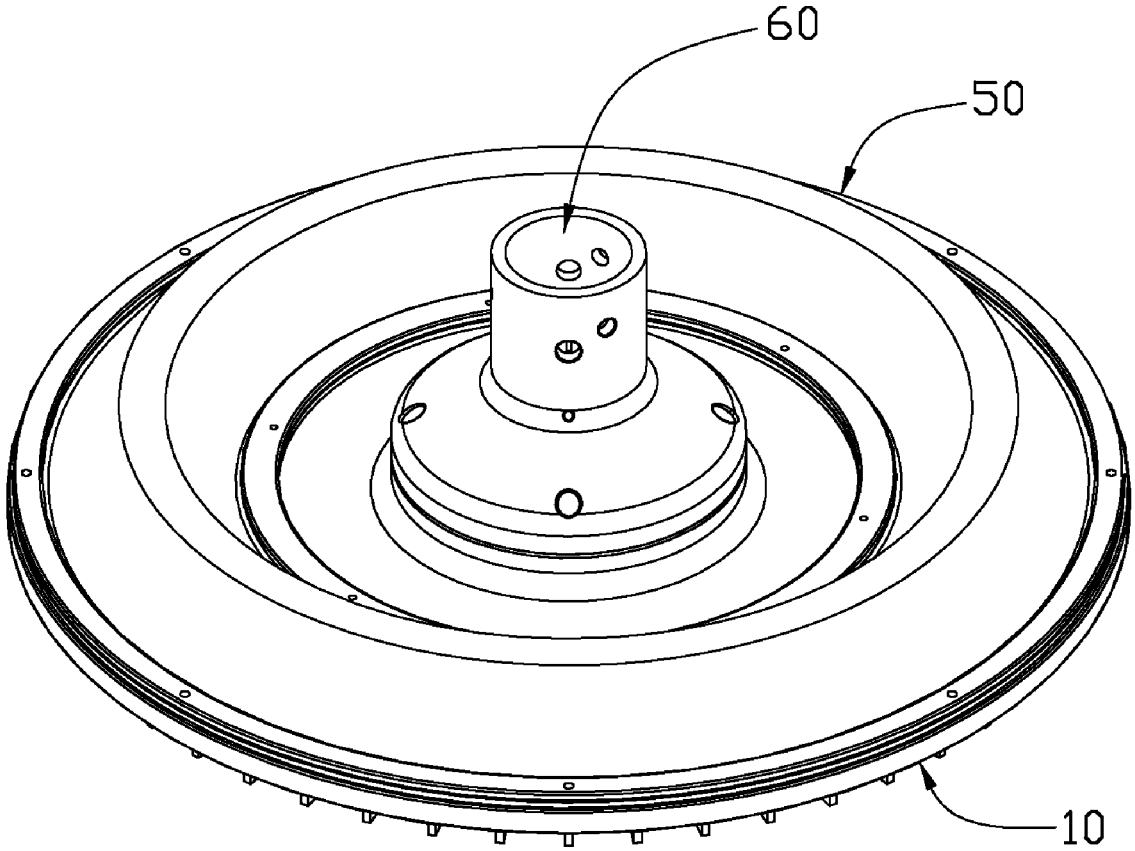
FIG. 3 is an inverted view of the LED lamp of FIG. 1.
Figure 4:
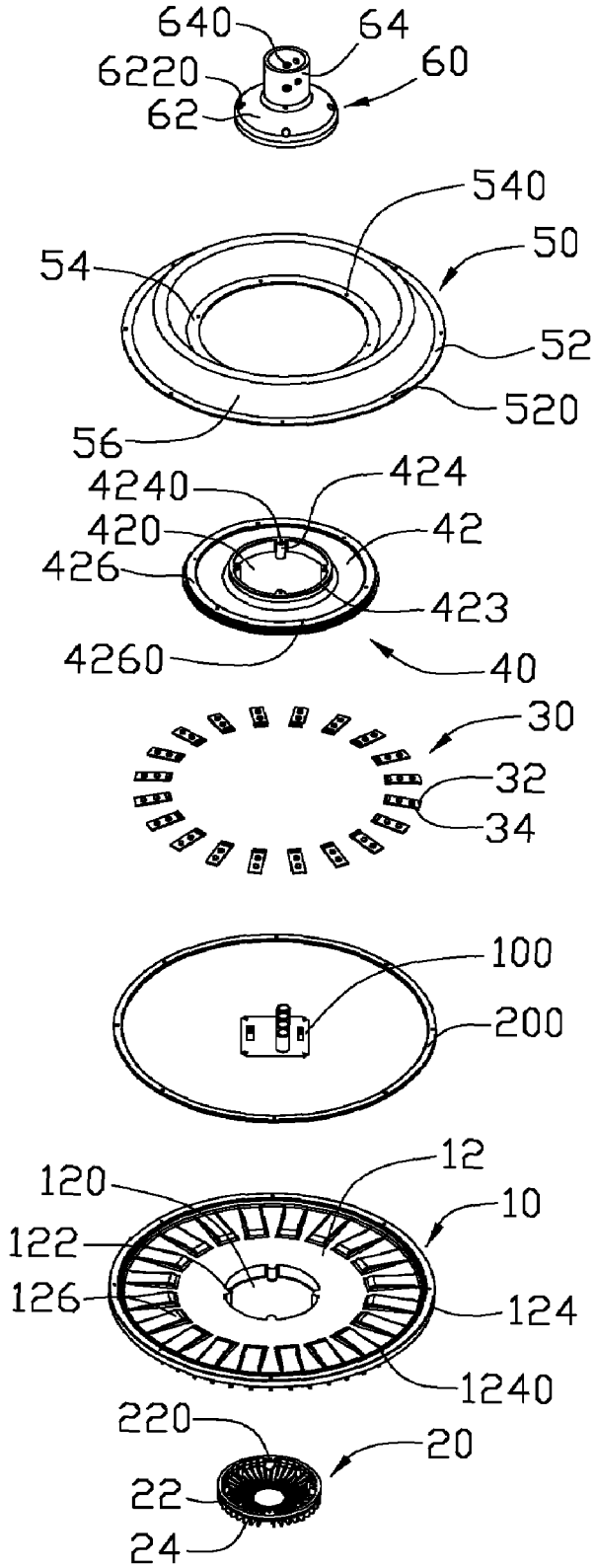
FIG. 4 is an exploded view of the LED lamp of FIG. 3.

Particularly referring to FIGS. 2 and 4, the first heat sink 10 is integrally made of a metal with good heat conductivity such as copper and aluminum, and comprises an annular base plate 12 and a plurality of first fins 14 formed on a top surface of the base plate 12. The base plate 12 defines a through hole 120 in a centre thereof. A plurality of fixing posts 122 is provided at an inner edge of the base plate 12 defining the through hole 120 and centrosymmetrical to each other relative to a central axis of the first heat sink 10. Each of the fixing posts 122 defines an engaging orifice 1220 therein, for engagingly receiving screws (not shown) extending through the second heat sink 20 to couple the first and second heat sinks 10, 20 together. The base plate 12 has an annular protruding rim 124 which protrudes downwardly from a bottom surface of the base plate 12 and is located adjacent to a circumference of the base plate 12. The protruding rim 124 defines a plurality of fixing orifices 1240 therein for engaging with screws (not shown) to fix the cover 50 on the first heat sink 10. A plurality of radially-extending, rectangular mounting portions 126 is formed on the bottom surface of the base plate 12 and located adjacent to the protruding rim 124. The mounting portions 126 are centrosymmetrical to each other relative to the central axis of the first heat sink 10 and have flat bottom surfaces (not labeled) on which the LED modules 30 are respectively mounted. The bottom surfaces are inclined inwardly downwardly, whereby an outer end of the bottom surface of the mounting portion 126 which is adjacent to the circumference of the base plate 12 is higher than an inner end of the bottom surface of the mounting portion 126. Thus, the LED modules 30 can generate a light having a large-scale illumination area. The first fins 14 are respectively arranged along the radial direction and centrosymmetrical to each other relative to the central axis of the first heat sink 10.

The second heat sink 20 which is integrally made of a metal with good heat conductivity such as copper and aluminum, comprises a circular covering plate 22 and a plurality of second fins 24 which are arranged radially on a top surface of the covering plate 22. The covering plate 22 has a size slightly larger than that of the through hole 120 of the first heat sink 10 and is fitly connected to the inner edge of the base plate 12 defining the through hole 120. The covering plate 22 defines a plurality of through orifices 220 adjacent to a circumference thereof. Screws (not shown) are used to extend through the through orifices 220 to threadedly engage in the engaging orifices 1220 to secure the second heat sink 20 on the first heat sink 10. The second heat sink 20 covers a top of the through hole 120.

The LED modules 30 each comprise a rectangular circuit board 32 attached to the bottom surface of the mounting portion 126 of the first heat sink 10 and a plurality of LEDs 34 mounted on the circuit board 32.

The connecting member 40 is configured to couple the mounting base 60 to the bottom of the first heat sink 10. The connecting member 40 has an annular plate 42 with a through hole 420 therein, which is in alignment with the through hole 120 of the first heat sink 10. An annular sidewall 423 extends downwardly from an inner edge of the connecting member 40 defining the through hole 420. A plurality of fixing posts 424 is formed on an inner side of the sidewall 423 and in alignment with the fixing posts 122 of the first heat sink 10. The fixing posts 424 each define an engaging orifice 4240 therein for engagingly receiving screws (not shown) extending through the mounting base 60 to couple the mounting base 60 and the connecting member 40 together. The annular plate 42 has a flat top surface fixed to the bottom surface of the base plate 12 of the first heat sink 10 and an engaging rim 426 protruding downwardly from a fringe portion of a bottom surface thereof. The engaging rim 426 defines a plurality of securing orifices 4260 therein for engagingly receiving screws (not shown) extending through the cover 50 to thereby connect the cover 50 and the connecting member 40 together.

The cover 50 is made of transparent plastic or glass and comprises an outer engaging flange 52, an inner engaging flange 54 and a covering portion 56 interconnecting the outer and inner engaging flanges 52, 54. The outer and inner engaging flanges 52, 54 are annular and concentric with each other. The outer and inner flange 52, 54 defines a plurality of piercing orifices 520, 540. The covering portion 56 is V-shaped in cross section, thereby forming a V-shaped receiving space accommodating the LED modules 30 therein.

The mounting base 60 has a bowl-shaped body 62 and a sleeve 64 extending downwardly from a central portion of a bottom of the bowl-shaped body 62. The bowl-shaped body 62 is provided with four vertical mounting posts 622 evenly located at an inner side of a sidewall thereof. Each of the mounting posts 622 defines a through orifice 6220 therein. A screw (not shown) is used to extend upwardly through the through orifice 6220 and screw into the engaging orifice 4240 of the fixing post 424 of the connecting member 40 to securely couple the mounting base 60 to the connect member 40. The bowl-shaped body 62 in a centre of the bottom thereof defines a piercing hole 624 communicating with the sleeve 64 for extension of lead wires (not shown) therethrough. The sleeve 64 is configured to receive the fixing rod therein and defines a plurality of radial locking holes 640 therethrough. The locking holes 640 are used for allowing a plurality of bolts (not shown) inserted therein to securely lock the mounting base 60 to the fixing rod.

In assembly of the LED lamp, the second heat sink 20 is secured on the top of the first heat sink 10 and covers the through hole 120 of the first heat sink 10 by the screws extending through the through orifices 220 of the second heat sink 20 and engaging into the engaging orifices 1220 of the first heat sink 10. Each of the LED modules 30 is mounted onto one of bottom surfaces of the mounting portions 126 of the first heat sink 10. The connecting member 40 with the through holes 420 and fixing posts 424 respectively connected and in alignment with the through hole 120 and the fixing posts 122, is fixed to a central part the bottom surface of the first heat sink 10 by soldering or adhering. The outer and inner engaging flanges 52, 54 are respectively coupled to a bottom of the protruding rim 124 of the first heat sink 10 and a bottom of the engaging rim 426 of the connecting member 40. The screws extend through the piercing orifices 540 of the inner engaging flange 54 to threadedly engage in the securing orifices 4260 of the engaging rim 426 of the connecting member 40. The screws extend through the piercing orifices 520 of the outer engaging flange 52 to threadedly engage in the fixing orifices 1240 of the protruding rim 124 of the first heat sink 10, whereby the cover 50 is fixed to both the connecting member 40 and the first heat sink 10. A rectifier 100 is provided in the LED lamp and received in the through holes 120, 420 of the first heat sink 10 and the connecting member 40. To prevent creeping of rainwater or dust into the LED lamp, the LED lamp is provided with a waterproof gasket 200 which is sandwiched between the protruding rim 124 of the first heat sink 10 and the outer engaging flange 52 of the cover 50.

Figure 5:
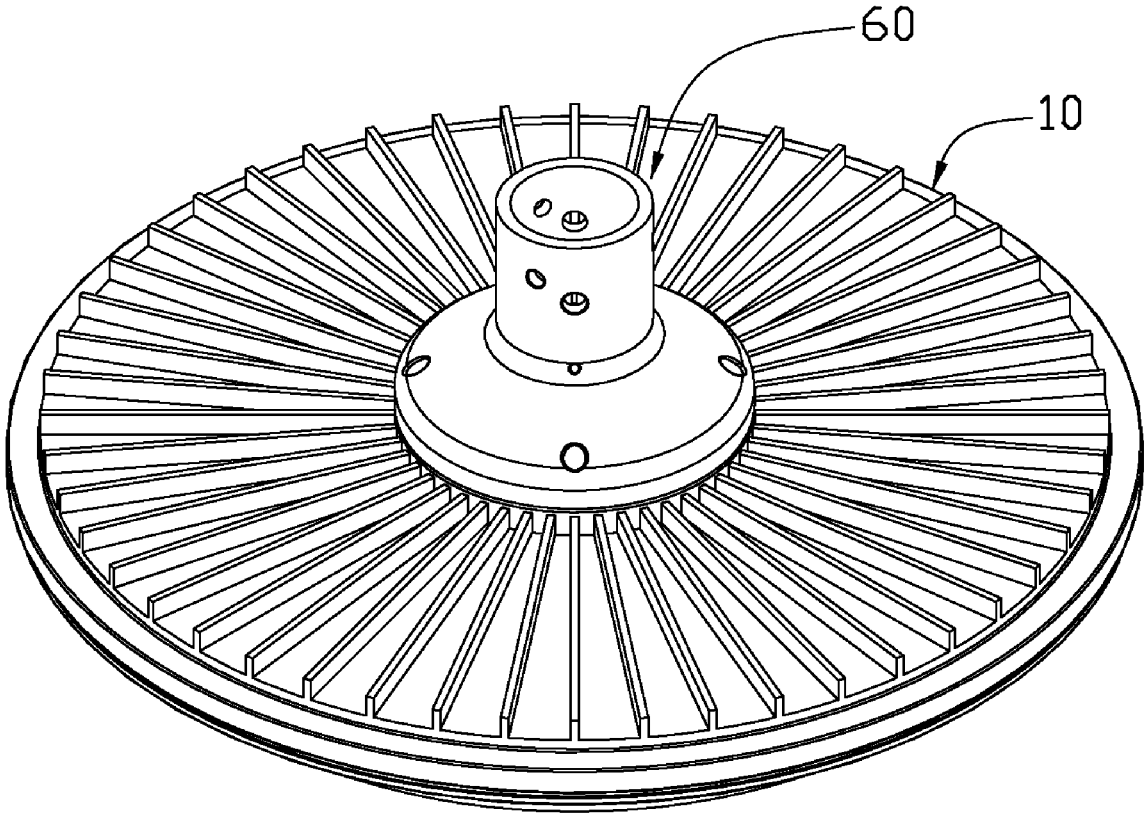
FIG. 5 is an isometric, assembled view of an LED lamp assembly in accordance with a second preferred embodiment of the present invention.
Figure 6:
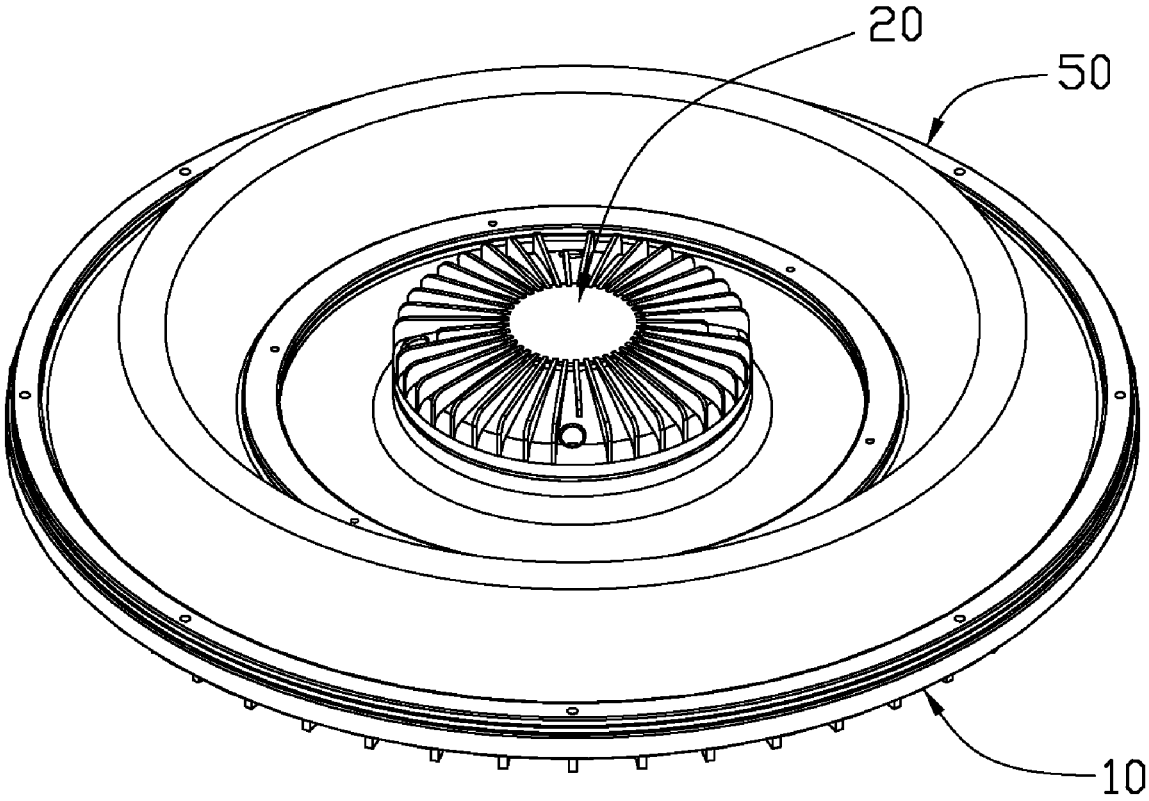
FIG. 6 is an inverted view of the LED lamp of FIG. 5.

As shown in FIGS. 5 and 6, an LED lamp assembly assembled in another way in accordance with a second preferred embodiment is illustrated. In the second embodiment, the positions of the second heat sink 20 and the mounting base 60 of the first embodiment are exchanged. The second heat sink 20 is fixed to the connecting member 40. The mounting base 60 is fixed to the top of the first heat sink 10 and the LED lamp thus can be used as a suspension lamp. In the first embodiment, the fixing rod is extended upwardly to support the LED lamp. In the second embodiment, the fixing rod is extended downwardly to support the LED lamp.

According to aforementioned descriptions, the mounting base 60 can be alternatively mounted to the top or the bottom of the first heat sink 10 and the LED lamp can be easily selectively configured as a floor lamp or a pendant lamp, whereby the versatility of the LED lamp is enhanced.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a first heat sink having a base plate and a plurality of first fins arranged on the base plate;

a plurality of LED modules attached to a bottom surface of the base plate;

a mounting base fixed to one of a top and a bottom of the first heat sink; and a second heat sink coupled to another one of the top and the bottom of the first heat sink, and the second heat sink and the mounting base are separated from each other by the first heat sink.

2. The LED lamp as claimed in claim 1, further comprising a connecting member fixed to the bottom surface of the base plate of the first heat sink, wherein the second heat sink and the mounting base are alternatively secured to a bottom of the connecting member.

3. The LED lamp as claimed in claim 2, wherein the base plate of the first heat sink and the connecting member both are annular and in centers thereof define through holes, respectively, the through holes communicating with each other.

4. The LED lamp as claimed in claim 3, wherein the second heat sink and the mounting base cover the through holes at two opposite sides of the first heat sink and the connecting member, respectively.

5. The LED lamp as claimed in claim 4, wherein the second heat sink comprises a covering plate covering a corresponding one of the through holes and a plurality second fins radially arranged on the covering plate.

6. The LED lamp assembly as claimed in claim 4, wherein the mounting base has a bowl-shaped body and a sleeve extending downwardly from a central portion of a bottom of the bowl-shaped body, the bowl-shaped body connected to a corresponding one of the first heat sink and the connecting member.

7. The LED lamp as claimed in claim 6, wherein the first heat sink and the connecting member are provided with a plurality of fixing posts at inner edges thereof defining the through holes thereof.

8. The LED lamp as claimed in claim 7, wherein the fixing posts of the first heat sink are respectively in alignment with those of connecting member, each fixing post defining therein an engaging hole.

9. The LED lamp as claimed in claim 2, wherein the base plate of the first heat sink has an annular protruding rim which protrudes downwardly from a bottom surface thereof and is located adjacent to a circumference thereof, a plurality of mounting portions extending downwardly from the bottom surface of the base plate and surrounding the connecting member.

10. The LED lamp as claimed in claim 9, wherein the mounting portions are extended along a radial direction and are centrosymmetrical to each other relative to a central axis of the first heat sink, the mounting portions having inclined flat bottom surfaces on which the LED modules are respectively mounted.

11. The LED lamp as claimed in claim 10, wherein the bottom surfaces of the mounting portion are inclined inwardly downwards, whereby an outer end of each of the bottom surfaces of the mounting portions which is adjacent to the circumference of the base plate is higher than an inner end of the each of the bottom surfaces of the mounting portions.

12. The LED lamp as claimed in claim 2, further comprising a cover having an outer engaging flange attached to the bottom surface of the base plate of the first heat sink, an inner engaging flange fixed to a bottom of the connecting member and a covering portion interconnecting the outer and inner engaging flanges and covering the LED modules.

13. The LED lamp as claimed in claim 12, wherein the covering portion is V-shaped in cross section, thereby forms a V-shaped receiving space accommodating the LED modules therein.

14. An LED lamp comprising:

a first heat sink having a plurality of radially-extending mounting portions at a bottom thereof, wherein each of the mounting portions having a bottom surface inclined inwardly downward;

a plurality of LED modules each mounted to the bottom surface of each of the mounting portions;

a connecting member secured to the bottom of the first heat sink;

a cover secured to both the first heat sink and the connecting member and covering the LED modules;

a mounting base adapted for connecting with a fixing post for supporting the LED lamp; and a covering member;

wherein the mounting base is selectively secured to one of the first heat sink and the connecting member and the covering member is selectively secured to the other one of the first heat sink and the connecting member.

15. The LED lamp as claimed in claim 14, wherein the covering member is a second heat sink.

16. The LED lamp as claimed in claim 15, wherein the second heat sink is secured to the first heat sink.

17. The LED lamp as claimed in claim 14, wherein the cover forms a V-shaped space receiving the LED modules therein.

* * * * *